US007465491B2

(12) United States Patent
Hasegawa et al.

(10) Patent No.: US 7,465,491 B2
(45) Date of Patent: Dec. 16, 2008

(54) ANISOTROPIC CONDUCTIVE SHEET AND ITS MANUFACTURING METHOD

(75) Inventors: Miki Hasegawa, Aichi (JP); Takeshi Watanabe, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 478 days.

(21) Appl. No.: 10/508,049

(22) PCT Filed: Mar. 20, 2003

(86) PCT No.: PCT/JP03/03462

§ 371 (c)(1),
(2), (4) Date: Mar. 7, 2005

(87) PCT Pub. No.: WO03/079496

PCT Pub. Date: Sep. 25, 2003

(65) Prior Publication Data

US 2005/0145974 A1 Jul. 7, 2005

(30) Foreign Application Priority Data

Mar. 20, 2002 (JP) ..... 2002-079748

(51) Int. Cl.
*B32B 5/00* (2006.01)

(52) U.S. Cl. ..... 428/332; 428/323

(58) Field of Classification Search ..... 428/332, 428/323

See application file for complete search history.

(56) References Cited

U.S. PATENT DOCUMENTS 3,982,320 A 9/1976 Buchoff et al.
3,998,513 A * 12/1976 Kobayashi et al. ..... 439/91
6,040,037 A 3/2000 Imai

FOREIGN PATENT DOCUMENTS

| | | | |
|---|---|---|---|
| JP | 51-87787 | A | 7/1976 |
| JP | 57-138791 | A | 8/1982 |
| JP | 57-141807 | A | 9/1982 |
| JP | 60-50468 | U | 4/1985 |
| JP | 60-264071 | A | 12/1985 |
| JP | 63-117066 | U | 7/1988 |
| JP | 4-341774 | A | 11/1992 |

(Continued)

OTHER PUBLICATIONS

Supplementary European Search Report, Application No. EP 03 74 4535, dated Jul. 7, 2006.

(Continued)

*Primary Examiner*—Carol Chaney
*Assistant Examiner*—Elizabeth Robinson
(74) *Attorney, Agent, or Firm*—Rader, Fishman & Grauer, PLLC

(57) ABSTRACT

An anisotropic conductive sheet interposed between a circuit board such as a substrate and various circuit parts to render them conductive and its manufacturing method. The anisotropic conductive sheet has a fine pitch required by the recent highly integrated circuit boards and electronic parts. In the anisotropic conductive sheet in which conductive members are scattered in a nonconductive matrix, the conductive members (e.g., 24) penetrate through the sheet (10) in the direction of thickness and conductive auxiliary layers (e.g., 25) are in contact with the conductive members (e.g., 24).

4 Claims, 8 Drawing Sheets

FOREIGN PATENT DOCUMENTS

| | | | | |
|---|---|---|---|---|
| JP | 04341774 | A | * | 11/1992 |
| JP | 06045025 | A | * | 2/1994 |
| JP | 6-61660 | A | | 3/1994 |
| JP | 07153313 | A | * | 6/1995 |
| JP | 8-285917 | A | | 1/1996 |
| JP | 11-231010 | A | | 8/1999 |
| JP | 11-260446 | A | | 9/1999 |
| JP | 11-345643 | A | | 12/1999 |
| JP | 2000-58158 | A | | 2/2000 |
| JP | 2000-113923 | A | | 4/2000 |
| JP | 2000-243489 | A | | 9/2000 |
| JP | 2000-340037 | A | | 12/2000 |
| JP | 2001-266975 | A | | 9/2001 |
| JP | 2001-332322 | A | | 11/2001 |

OTHER PUBLICATIONS

Chinese Office Action, #038065681, Received Date Jan. 16, 2007 (7 pages).

* cited by examiner

B—B cross section

ANISOTROPIC CONDUCTIVE SHEET AND ITS MANUFACTURING METHOD

FIELD OF THE INVENTION

This invention relates to an anisotropic conductive sheet which is interposed between a circuit board such as a substrate and various circuit components to conductive paths and to a manufacturing method thereof.

RELATED ART

As electronic devices become smaller in size and thinner in thickness, connecting minute circuits and connecting minute portions and circuitry are more and more demanding. Connection methods thereof are based upon the solder junction technology and the use of anisotropic conductive adhesive. There is employed a method of interposing an anisotropic conductive elastomer sheet between the electronic parts (components) and the circuit board to render conductive paths.

The anisotropic conductive elastomer sheets include sheets having conductivity only in the direction of thickness or conductivity only in the direction of thickness when the sheets are compressed in the direction of thickness. They have such features as accomplishing compact electric connection without using such means as soldering or mechanical fitting, and realizing a soft connection so as to absorb mechanical shocks and distortion. Therefore, they have been extensively used as connectors for achieving electric connection relative to circuit devices such as printed circuit board, leadless chip carrier and liquid crystal panel in the fields of cell phones, electronic calculators, electronic digital clocks, electronic cameras, computers and the like.

In the electric test of the circuit devices such as printed circuit boards and semiconductor integrated circuits, further, the anisotropic elastomer sheet has heretofore been interposed between a region of electrodes of the circuit device to be tested and a region of testing electrodes of the circuit board for the test in order to achieve electric connection between the tested electrodes formed on at least one surface of the circuit device to be tested and the testing electrodes formed on the surface of the circuit board for the test.

It is known that an example of the above anisotropic conductive elastomer sheet may be obtained by cutting an anisotropic conductive block in a thin sheet such that the block that is formed integrally with thin metal wires disposed in parallel and insulating material enclosing the metal wires is cut in a direction orthogonal to the direction of the thin metal wires (JP-A-2000-340037).

In the anisotropic conductive film with thin metal wires, however, it is difficult to shorten distance between such thin metal wires and to secure anisotropic conductivity with a fine pitch as required by recent highly integrated circuit boards and electronic components. Further, it is likely that thin metal wires are to be buckled with compressive force or the like during the use thereof and easily pulled out after repetitive use so that the anisotropic conductive film may fail to keep its function to a sufficient degree.

Therefore, this invention provides an anisotropic conductive sheet having a fine pitch required by the recent highly integrated circuit boards and electronic components, the anisotropic conductive sheet yet keeping high conductivity in the direction of thickness and preventing conductive members such as metals from slipping out.

DISCLOSURE OF THE INVENTION

In the present invention, it is provided an anisotropic conductive sheet in which conductive members are scattered in a nonconductive matrix, wherein the conductive members penetrate in the direction of thickness and conductive auxiliary layers are in contact with the conductive members.

More specifically, the present invention provides the following.

(1) An anisotropic conductive sheet expanding on a first plane, wherein: when a first direction contained in said first plane is denoted as X-direction, a direction orthogonal to X-direction and contained in said first plane is denoted as Y-direction and a direction orthogonal to X-direction and Y-direction is denoted as Z-direction; and the anisotropic conductive sheet has a predetermined thickness in Z-direction and a front surface and a back surface substantially in parallel with said first plane, the anisotropic conductive sheet comprising: a nonconductive matrix expanding on said first plane; conductive pieces scattered in the nonconductive matrix; and conductive auxiliary layers in contact with the scattered conductive pieces, wherein said scattered conductive pieces extend in Z-direction so as to penetrate the anisotropic conductive sheet from the front surface to the back surface.

(2) The anisotropic conductive sheet according to (1), wherein said conductive auxiliary layers penetrate the anisotropic conductive sheet from the front surface to the back surface along the scattered conductive pieces.

(3) An anisotropic conductive sheet expanding on a first plane, wherein: when a first direction contained in said first plane is denoted as X-direction, a direction orthogonal to X-direction and contained in said first plane is denoted as Y-direction and a direction orthogonal to X-direction and Y-direction is denoted as Z-direction, and the anisotropic conductive sheet has a predetermined thickness in Z-direction and a front surface and a back surface substantially in parallel with said first plane, the anisotropic conductive sheet comprising: strip-like members of a striped pattern having a width in Y-direction and extending in X-direction and conductive pieces and nonconductive pieces alternately arranged in X-direction; and nonconductive strip-like members having a width in Y-direction and extending in X-direction, wherein the strip-like members and the nonconductive strip-like members are arranged relative to each other in Y-direction, and wherein in said strip-like members of a striped pattern, a conductive auxiliary layer is arranged between the conductive piece and the nonconductive piece while in contact with said conductive piece.

(4) The anisotropic conductive sheet according to any one from (1) to (3), wherein the conductive auxiliary layer comprises an adhesive layer and a conductive layer.

(5) The anisotropic conductive sheet according to any one from (1) to (4), wherein the adhesive layer is arranged on a conductive piece side of the conductive auxiliary layer.

(6) The anisotropic conductive sheet according to (4) or (5), wherein the adhesive layer comprises indium tin oxide.

(7) The anisotropic conductive sheet according to any one from (4) to (6), wherein the conductive layer is made of material having good conductivity.

(8) The anisotropic conductive sheet according to (1) or (2), wherein the nonconductive matrix comprises a conductive elastomer and the scattering conductive pieces comprise a conductive elastomer.

(9) The anisotropic conductive sheet according to (3), wherein the nonconductive pieces and the nonconductive strip-like members comprise a nonconductive elastomer and the conductive pieces comprise a conductive elastomer.

(10) The anisotropic conductive sheet according to any one from (1) to (9), wherein the scattered conductive pieces or the conductive pieces are protruded as compared to surroundings thereof along Z-direction.

(11) A method of manufacturing a flexible anisotropic conductive sheet having a predetermined thickness, and predetermined front and back surfaces on the front and back across the thickness, the method comprising: a step of adhering a conductive auxiliary layer on the surface of a conductive sheet (A) made of a conductive member so as to obtain a conductive sheet (A) with the conductive auxiliary layer; a step of alternately laminating the conductive sheet (A) with the conductive auxiliary layer obtained in the step of adhering the layers and a nonconductive sheet (B) so as to obtain an AB sheet laminate (C); a first step of cutting the AB sheet laminate (C) obtained in the step of obtaining the AB sheet laminate to obtain a zebra-like sheet in a predetermined thickness; a step of alternately laminating the zebra-like sheet obtained in the first cutting step and a nonconductive sheet (D) to obtain a ZD sheet laminate (E); and a second step of cutting the ZD sheet laminate (E) with a predetermined thickness, which is obtained in the step of obtaining the ZD sheet laminate.

In this invention, it is characterized in that an anisotropic conductive sheet comprises conductive members scattered in the nonconductive matrix, in which the conductive members penetrates the sheet in the thickness direction, wherein the conductive auxiliary layers are in contact with the conductive members. Here, the nonconductive matrix is a sheet member made of nonconductive material so as to insulate the scattering conductive pieces in directions contained in the plane of the sheet (directions in X-Y plane) to maintain non-conductivity in the directions contained in the plane of the whole anisotropic conductive sheet. Usually, the nonconductive matrix is all connected (being continuous) in the anisotropic conductive sheet to form an anisotropic conductive sheet. The nonconductive matrix, however, may not have to be continuous. Further, the scattered conductive pieces may refer to a condition that one or more conductive pieces made of a conductive material are spread separately from each other in directions contained in the plane of the sheet.

"The scattered conductive pieces made of a conductive material penetrate the anisotropic conductive sheet from the front surface to the back surface," may mean that the conductive pieces penetrate the sheet in the thickness direction, may mean that the conductive pieces appear on both front and back surfaces of the anisotropic conductive sheet, or may mean that the sheet has a function for electrically connecting the front and back surfaces. "The conductive auxiliary layers are in contact with the conductive members" may mean that the conductive auxiliary layers are electrically connected to the conductive members. The conductive auxiliary layers have conductivity higher than the conductive members. When the electricity flows in parallel (as being parallel-connected), therefore, the electric conductivity of the conductive auxiliary layers become dominant in the entire conductivity. As a result, the resistance between the front and the back of the sheet becomes low when the conductive auxiliary layers are adhered, and may become equal to the resistance of the conductive auxiliary layers. Here, the conductive auxiliary layers that are made of metal material can be called metal layers. In the case of the metal layer, the metal layer as a whole may be made of metal of a single kind.

The anisotropic conductive sheet of the present invention expands on a plane, and the feature of the sheet can be described by using X-direction and Y-direction which are two directions in parallel with the plane, and Z-direction orthogonal to X-direction and Y-direction. The anisotropic conductive sheet has thickness in Z-direction, the strip-like member of the striped pattern has a width in Y-direction and extends in X-direction, and the conductive pieces made of conductive material and nonconductive pieces made of nonconductive material are alternately arranged in X-direction. Further, the nonconductive strip-like member has width in Y-direction and extends in X-direction. The strip-like members having the striped pattern and the nonconductive strip-like members are arranged in Y-direction, and are included in the anisotropic conductive sheet in this state. In the strip-like members of the striped pattern, the conductive auxiliary members are arranged among the conductive pieces and the nonconductive pieces while in contact with the conductive pieces.

Being conductive may mean that the anisotropic conductive sheet of such constitution has sufficiently high conductivity in the conduction direction. It is usually preferable that the resistance among the terminals to be connected is not larger than 100 Ω (preferably, not larger than 10 Ω and, more preferably not larger than 1 Ω ). The strip-like member of the striped pattern may be thin and elongated in X-direction such that conductive members and nonconductive members are alternately arranged along X-direction, wherein a striped pattern may appear if the conductive members and the nonconductive members have different colors. In practice, they need not appear in a striped pattern. The alternate arrangement needs not expand over the whole strip-like members in X-direction but may exist in only a portion thereof. Further, "the conductive auxiliary layers being in contact with the conductive members"may stand for the electric connection in the same manner as described above.

In the anisotropic conductive sheet of the present invention, further, it may be characterized in that the conductive auxiliary layers comprise the adhesive layers and the conductive layers. Here, the adhesive layers may be those for improving the adhesion to the conductive members while the conductive auxiliary layers come in contact with the conductive members. The conductive layers of the conductive auxiliary layers have physical and chemical properties which are greatly different from the physical and chemical properties of the conductive members so that the adhesive layers have a function to improve adhesion between them as the adhesive layers have intermediate properties and bond the conductive layer and the conductive member. Therefore, it may be characterized in that the adhesive layers are arranged on the side of the conductive member being in contact with the conductive auxiliary layers comprising the adhesive layers as a constituent element. For example, it may be possible to lower or absorb distortion caused by the different thermal expansion rate.

Further, it may be characterized in that the adhesive layer is arranged on the side of the nonconductive matrix while the conductive auxiliary layer is in contact with the nonconductive matrix. Here, being in contact with the nonconductive matrix may mean that the conductive auxiliary layers are physically (mechanically) in contact with the nonconductive matrix. This is because the nonconductive matrix is insulative. Being arranged on the side of the nonconductive matrix may mean that the adhesive layer is positioned between the conductive layer and the nonconductive matrix. Here, the adhesive layer may be a layer to improve the adhesion to the nonconductive matrix while the conductive auxiliary layer is in contact with the nonconductive matrix. The conductive layer of the conductive auxiliary layer has physical and chemical properties which are greatly different from the physical and chemical properties of the conductive member so that the adhesive layer can have a function to improve the adhesion between them as the adhesive layer has intermediate properties and bonds the conductive auxiliary layer and the conductive member. Therefore, it may be characterized in that the adhesive layers are arranged on the side of the conductive members which are in contact with the conductive auxiliary layers comprising the adhesive layer as a constituent element. For example, distortion caused by different thermal expansion rate can be lowered or absorbed.

It may be characterized in that the adhesive layer comprises a metal oxide or a metal. Examples of the metal oxide include indium oxide, tin oxide, titanium oxide, a mixture thereof and a compound thereof, and examples of the metal include chromium. For example, it may be characterized in that the adhesive layer comprises indium tin oxide (or indium oxide/tin oxide). Indium tin oxide (or indium oxide/tin oxide) is a ceramic material abbreviated as ITO and has high electric conductivity. The conductive layer may be made of metal having good conductivity. If the metal has electric conductivity higher than that of the conductive members and if electricity flows in parallel therewith (in a parallel-connected manner), the electric resistance of the metal controls the entire electric resistance.

In the anisotropic conductive sheet of the present invention, further, it may be characterized in that the nonconductive matrix comprises a nonconductive elastomer, and the conductive members comprise a conductive elastomer.

The conductive elastomer stands for an elastomer having electric conductivity and is, usually, an elastomer blended with a conductive material so as to lower the volume resistivity (smaller than, for example, 1 Ω-cm). For examples, butadiene copolymers such as natural rubber, polyisoprene rubber, butadiene/styrene, butadiene/acrylonitrile, butadiene/isobutylene, conjugated diene rubber and hydrogenated compounds thereof; block copolymer rubbers such as styrene/butadiene/diene block copolymer rubber, styrene/isoprene block copolymer, and hydrogenated compounds thereof; and chloroprene copolymer, vinyl chloride/vinyl acetate copolymer, urethane rubber, polyester rubber, epichlorohydrin rubber, ethylene/propylene copolymer rubber, ethylene/propylene/diene copolymer rubber, soft liquid epoxy rubber, silicone rubber and fluorine-contained rubber may be utilized. Among them, the silicone rubber is preferably used owing to its excellent heat resistance, cold resistance, chemical resistance, aging resistance, electric insulation and safety. The elastomer may be blended with a conductive substance like a powder (flakes, small pieces, foils, etc. are allowable) of a metal such as gold, silver, copper, nickel, tungsten, platinum, palladium or any other pure metal, SUS, phosphor bronze or beryllium copper, or a nonmetallic powder (flakes, small pieces, foils, etc. can be utilized) such as carbon powder to obtain a conductive elastomer. Here, carbon may include carbon nano-tube and fullerene.

The nonconductive elastomer stands for elastomer without conductivity or having a very low conductivity, or elastomer having a sufficiently high electric resistance. By way of example, butadiene copolymers such as natural rubber, polyisoprene rubber, butadiene/styrene, butadiene/acrylonitrile, butadiene/isobutylene, conjugated diene rubber and hydrogenated compounds thereof; block copolymer rubbers such as styrene/butadiene/diene block copolymer rubber, styrene/isoprene block copolymer, and hydrogenated compounds thereof; and chloroprene copolymer, vinyl chloride/vinyl acetate copolymer, urethane rubber, polyester rubber, epichlorohydrin rubber, ethylene/propylene copolymer rubber, ethylene/propylene/diene copolymer rubber, soft liquid epoxy rubber, silicone rubber and fluorine-contained rubber may be employed. Among them, the silicone rubber is preferably used owing to its excellent heat resistance, cold resistance, chemical resistance, aging resistance, electric insulation and safety. The nonconductive elastomer usually has high volume resistivity (e.g., not smaller than 1 MΩ-cm at 100 V) and is nonconductive.

In order to chemically bond the conductive elastomer and the nonconductive elastomer, a coupling agent may be applied between them. The coupling agent is an agent for coupling these members, and may include an adhesive commercially available. By way of example, coupling agents of the types of silane, aluminum and titanate may be utilized. Among them, a silane coupling agent is favorably used.

In the anisotropic conductive sheet of the present invention, it may be characterized in that the conductive members are protruded as compared to the nonconductive matrix. "Protruding" refers to a case where the portion of the conductive member is thicker than the portion of the nonconductive matrix in the thickness direction of the anisotropic sheet, a case where the position of the upper surface of the nonconductive matrix is lower than the position of the upper surface of the conductive member when the anisotropic conductive sheet is horizontally placed, and/or a case where the position of the lower surface of the nonconductive matrix is higher than the position of the lower surface of the conductive member when the anisotropic conductive sheet is horizontally placed. Then, the electric contact becomes more reliable to the electronic parts and to the terminals of the substrate. This is because the terminals, first, come in contact with the conductive members as they approach the sheet such that a suitable degree of contact pressure is maintained due to the pushing force to the sheet.

A method of manufacturing an anisotropic conductive sheet according to the present invention comprises: a step of adhering conductive auxiliary layers on the surface of a conductive sheet (A) made of conductive material to obtain a conductive sheet (A) with the conductive auxiliary layers; a step of alternately laminating the conductive sheet (A) with the conductive auxiliary layers obtained in the step of adhering the layers and a nonconductive sheet (B) to obtain an AB sheet laminate (C); a first step of cutting the AB sheet laminate (C) obtained in the step of obtaining the AB sheet laminate to obtain a zebra-like sheet in a predetermined thickness; a step of alternately laminating the zebra-like sheet obtained in the first cutting step and a nonconductive sheet (D) to obtain a zebra-D (ZD) sheet laminate (E); and a second step of cutting the ZD sheet laminate (E) with a predetermined thickness obtained in the step of obtaining the ZD sheet laminate.

Here, the conductive sheet (A) may be a sheet member of a single kind or a collection of sheet members of different kinds. For example, the conductive sheet (A) may be a collection of sheet members of the same material but having different thicknesses. In the step of adhering the conductive auxiliary layers onto the surface of the conductive sheet member made of the conductive material, the conductive auxiliary layers may be adhered onto one surface or both surfaces of the sheet members. The conductive auxiliary layers can be adhered by any one of the vapor phase method, liquid phase method or solid phase method or by a combination thereof. Among them, the vapor phase is particularly preferred. As the vapor phase method, there can be exemplified PVD such as sputtering method and vacuum evaporation, and CVD. When the conductive auxiliary layer is constituted by the adhesive layer and the conductive layer, the respective layers may be adhered with the same method or with different methods.

The conductive sheet (A) with the conductive auxiliary layer and the nonconductive sheet (B) may be the sheet members of a single kind as described above or may be collections of sheet members of different kinds. Alternate stacking may mean that the conductive sheet (A) with the conductive auxiliary layer and the nonconductive sheet (B) are alternately stacked in any order, which, however, does not exclude interposing a third sheet, a film or any other members between the conductive sheet (A) with the conductive auxiliary layer and the nonconductive sheet (B). In the step of stacking the sheet members, further, a coupling agent may be applied among the sheets so that the sheets are coupled together. The AB sheet laminate (C) prepared by stacking may be heated in order to promote curing of the sheet members themselves for increasing the coupling among the sheets or for any other purposes.

The AB sheet laminate (C) can be cut with a blade such as a cemented carbide cutter blade or a ceramic cutter blade, with a grindstone such as a fine cutter, with a saw, or with any other cutting devices or cutting instruments (which may include a cutting device of the non-contact type, such as laser cutter). In the step of cutting, further, there may be used a cutting fluid such as a cutting oil to prevent over-heating, to obtain finely cut surfaces or for any other purpose, or a dry cutting may be employed. Further, the object (e.g., work) to be cut may be cut alone or by being rotated together with the cutting machine or instrument. It needs not be pointed out that a variety of conditions for cutting are suitably selected to meet the AB sheet laminate (C). To cut with a predetermined thickness may mean to cut the block to obtain a sheet member having a predetermined thickness. The predetermined thickness needs not be uniform but may vary depending upon the places of the sheet member.

The step of obtaining the ZD sheet laminate (E) by alternately stacking the zebra-like sheet and the nonconductive sheet (D) is the same as the step of obtaining the AB sheet laminate (C) from the conductive sheet (A) and the nonconductive sheet (B). Further, the second step of cutting the ZD sheet laminate (E) in a predetermined thickness is the same as the first step of cutting the AB sheet laminate (C).

DESCRIPTION OF THE PREFERRED EMBODIMENT

The present invention will now be described in further detail by way of embodiments with reference to the drawings. However, the embodiments are simply to illustrate concrete materials and numerical values as preferred examples of the present invention, but are not to limit the present invention.

Figure 1:
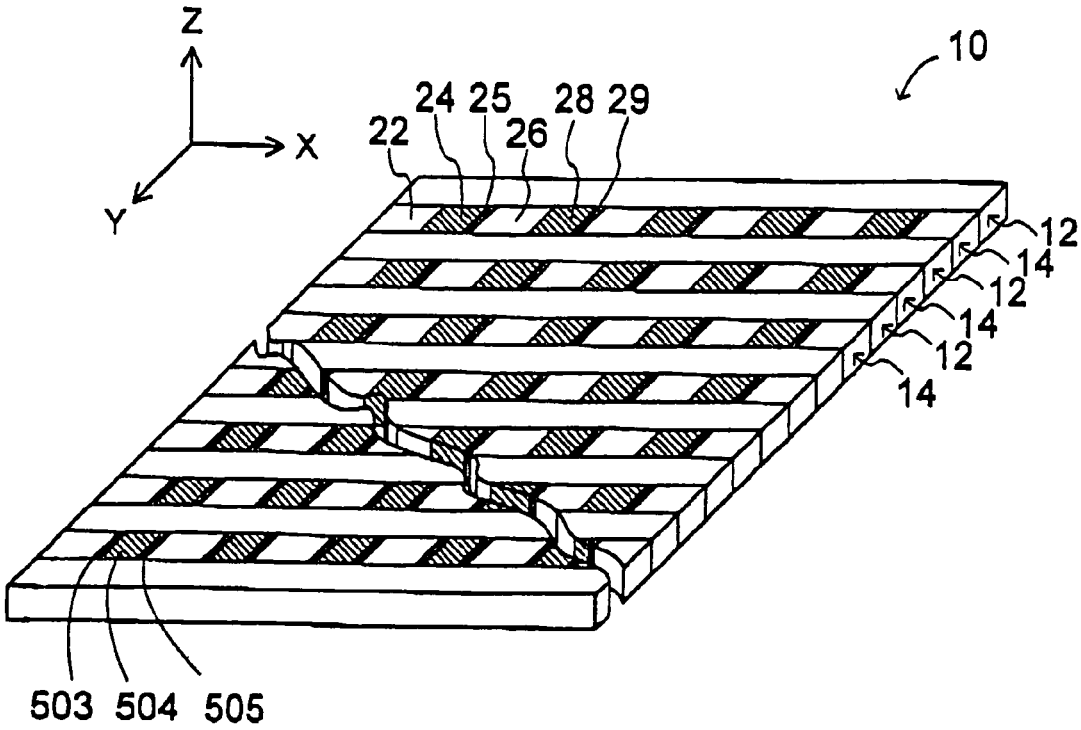
FIG. 1 is a perspective view with partially broken portions of an anisotropic conductive sheet according to an embodiment of the present invention, in which different patterns are shown across the broken surfaces.

FIG. 1 illustrates an anisotropic conductive sheet 10 according to an embodiment of the present invention. A Cartesian coordinate system XYZ of the anisotropic conductive sheet 10 is illustrated at a left upper part. The anisotropic conductive sheet 10 of this embodiment is a rectangular sheet member but may be a sheet member of a shape other than the rectangular shape. The anisotropic conductive sheet 10 has a constitution in which there are alternately arranged nonconductive strip-like members 12 and strip-like members 14 of a striped pattern having conductive pieces 24, 28 and nonconductive pieces 22, 26 that are alternately arranged. The nonconductive strip-like members 12 and the strip-like members 14 of the striped pattern adjoining each other are coupled by a coupling agent. The strip-like members 14 of the striped pattern are constituted by nonconductive pieces 22, 26, conductive pieces 24, 28, and conductive auxiliary layers 25, 29 in contact with the conductive pieces 24, 28. The members made of the nonconductive material constitute the nonconductive matrix, and the members made of the conductive material constitute conductive portions. When the conductive portions are scattering, the scattering conductive portions are obtained. Therefore, the scattered conductive portions exist in the nonconductive matrix in a scattered manner. In the anisotropic conductive sheet of this embodiment, the conductive elastomer is a conductive silicone rubber manufactured by Shin-etsu Polymer Co., the nonconductive elastomer is a silicone rubber manufactured by Mitsubishi Jushi Co. or a silicone rubber manufactured by Shin-etsu Polymer Co., and the coupling agent is a silane coupling agent manufactured by Shin-etsu Polymer Co. Here, if a metal material is used as the conductive auxiliary layer, then, it may be called metal layer.

FIG. 1 illustrates, on the left lower portion thereof, the anisotropic conductive sheet according to another embodiment with the broken surface as a boundary. The constitution of this embodiment is the same as that of the above embodiment except that the conductive auxiliary layers are adhered on both sides of the conductive pieces. For instance, conductive auxiliary layers 503 and 505 are adhered on both sides of the conductive piece 504 to improve the conductivity in the direction of thickness of the sheet.

Figure 2:
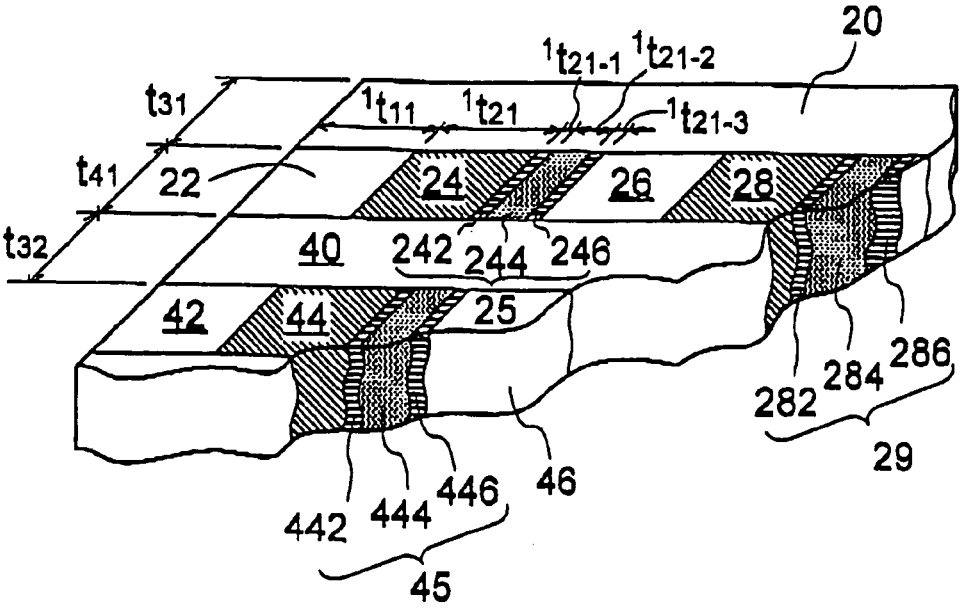
FIG. 2 is an enlarged view with partially broken portions of the upper left portion of the anisotropic conductive sheet in FIG. 1 according to an embodiment of the present invention.

FIG. 2 is a view illustrating on an enlarged scale the left upper corner portion of FIG. 1, i.e., illustrates the strip-like members 12 and 14 in further detail. The strip-like members 12 made of the nonconductive members of FIG. 1 correspond in FIG. 2 to strip-like members 20, 40, etc. As for the strip-like members 14 of the striped pattern of FIG. 1, the strip-like member including nonconductive pieces 22, 26 - - - , conductive pieces 24, 28 - - - and conductive auxiliary layers 25, 29, - - - corresponds to the strip-like member including nonconductive pieces 42, 46 - - - , conductive pieces 44 - - - and conductive auxiliary layers 45 - - - . Namely, the nonconductive strip-like member 20 is neighbored by a strip-like member including nonconductive pieces 22, 26, - - - , conductive pieces 24, 28, - - - and conductive auxiliary layers 25, 29, - - - which is further neighbored by a nonconductive strip-like member 40, and is further neighbored by a strip-like member including nonconductive pieces 42, 46, - - - , conductive pieces 44, - - - and conductive auxiliary layers 45, - - - . In this embodiment, the strip-like members have substantially the same thickness (T). The two strip-like members which are neighboring as described above are coupled together with the coupling agent. The conductive pieces with the conductive auxiliary layers and the nonconductive pieces that are neighboring to constitute the strip-like members 14 of the striped pattern, too, are coupled with the coupling agent to constitute a piece of sheet as shown in FIG. 1. Here, the coupling agent is nonconductive, and the sheet maintains the non-conductivity in the direction of a plane.

The conductive auxiliary layer 25 at the extreme left upper position is constituted by adhesive layers 242, 246 having thicknesses ${}^{1}t_{21\text{-}1}$ and ${}^{1}t_{21\text{-}3}$ and by a conductive layer 244 having a thickness ${}^{1}t_{21\text{-}2}$. Similarly, other conductive auxiliary layers 29, 45 are constituted by adhesive layers 282, 286, conductive layer 284, adhesive layers 442, 446 and conductive layer 444. In this embodiment, the adhesive layers are arranged on both sides of the conductive layer. In other embodiments, however, the adhesive layer may be arranged on either side only. It is, however, desired that the adhesive layer is between the conductive member and the conductive layer. The adhesive layer in this embodiment is constituted by the indium tin oxide, and the conductive layer is constituted by a copper alloy. In other embodiments, however, they may be replaced by other materials. These layers are formed by sputtering as will be described later.

The nonconductive strip-like members 20, 40, - - - have widths $t_{31}$, $t_{32}$, $t_{33}$, - - - , $t_{3k}$ (k is a natural number), and the strip-like members 14 of the striped pattern have widths $t_{41}$, - - - , $t_{4k}$ (k is a natural number). In this embodiment, these widths are all the same. In other embodiments, however, the widths may be all the same or may be all different. These widths can be easily adjusted in the method of producing the anisotropic conductive sheet of the embodiment that will be described later. Further, the strip-like members 14 of the striped pattern are constituted by nonconductive pieces 22, 26, - - - , 42, 46, - - - having lengths ${}^{1}t_{11}$, ${}^{1}t_{12}$, ${}^{1}t_{13}$, - - - , ${}^{1}t_{1m}$ (m is a natural number); ${}^{2}t_{11}$, ${}^{2}t_{12}$, ${}^{2}t_{13}$, - - - , ${}^{2}t_{1n}$ (n is a natural number), conductive pieces 24, 28, - - - , 44, - - - having lengths ${}^{1}t_{21}$, ${}^{1}t_{22}$, ${}^{1}t_{23}$, - - - , ${}^{1}t_{2m}$ (m is a natural number); ${}^{2}t_{21}$, ${}^{2}t_{22}$, ${}^{2}t_{23}$, - - - , ${}^{2}t_{2n}$ (n is a natural number), and conductive auxiliary layers 25, - - - . In this embodiment, the lengths of these nonconductive pieces and conductive pieces are all the same. In other embodiments, however, the lengths may all be the same or may be all different. These lengths can be easily adjusted in the method of producing the anisotropic conductive sheet of the embodiment that will be described later. In this embodiment, the conductive pieces in the strip-like members of the striped pattern have a length of about 50 μm, the nonconductive pieces have a length of about 30 μm, the strip-like members of the striped pattern have a width of about 50 μm and the nonconductive strip-like members have a width of about 50 μm. In other embodiments, however, the lengths may be longer (or larger) or shorter (or smaller), as a matter of course.

The extreme left upper conductive auxiliary layer 25 in this embodiment is constituted by the adhesive layer 242 in contact with the conductive piece 24, the conductive layer 244 in contact with the adhesive layer 242, and the adhesive layer 246 in contact with the conductive layer 244, the adhesive layer 246 being in contact with the nonconductive piece 26. As will be described later, the conductive auxiliary layers of this embodiment are formed by sputtering. By using the conductive piece 24 as a base plate, the indium tin oxide is, first, deposited like a film, a copper alloy is deposited next like a film and, then, the indium tin oxide is deposited like a film. In this embodiment, the boundaries of the layers are emphasized relatively clearly. However, the gradient of concentration may be mildly formed in the step of sputtering.

In this embodiment, the adhesive layer 242 has a thickness of about 500 angstroms, the conductive layer 244 has a thickness of about 5000 angstroms, and the next adhesive layer 246 has a thickness of about 500 angstroms. Therefore, the conductive auxiliary layer has a thickness of about 6000 angstroms. In other embodiments, however, these thicknesses may be freely varied, as a matter of course. In the foregoing was described the extreme left upper conductive auxiliary layer 25 of the embodiment. However, the same also holds for other conductive auxiliary layers 25, 29, - - - .

In general, it is desired that the conductive auxiliary layer is thinner than the length (e.g., ${}^{1}t_{21}$) of the conductive piece, more preferably, thinner than 1/10 thereof and, particularly preferably, thinner than 1/50 thereof. When the length of the conductive piece is as great as 0.1 mm or more, it is desired that the conductive auxiliary layer has a thickness of not larger than 10 μm.

In the case of this embodiment, the recurring distance is a value obtained by adding up the lengths of the two neighboring elastomers of different kinds, which is divided by 2, i.e., $[({}^{k}t_{1m}+{}^{k}t_{2m})/2]$ or $[({}^{k}t_{1m}+{}^{k}t_{2(m-1)})/2]$(k and m are natural numbers). Here, the thickness of the adhesive layer has not been taken into consideration. This is because the thickness is usually very small as compared to their lengths (when great, it is desired that the thickness is also taken into consideration). As for the whole anisotropic conductive sheet, an average value of these values may be used, a minimum value may be used, or a minimum value or an average value of a required place of the sheet may be used. When the average value is used, the sheet as a whole exhibits fine pitch performance. When the minimum value is used, a minimum gap between the terminals that can be guaranteed is defined. When the conductive elastomer is arranged relatively uniformly, further, the frequency of appearance of the conductive elastomer per a predetermined length may be used or the cumulative length of the conductive elastomer may be used in the strip-like members of the striped pattern. In this embodiment, the recurring distance is about 40 μm even if an average value or a minimum value is used, and the cumulative length of the conductive elastomer per a unit length is about 0.6 mm/mm.

The size of the anisotropic conductive sheet of this embodiment can be clearly indicated by adding up the widths and lengths described above. However, there is no limitation on the width or on the length and there is no limitation, either, on the thickness T. When used for connecting the circuit board to the terminals of the electronic parts, however, it is desired that the size matches with these sizes. In this case, the sizes are, usually, 0.5 to 3.0 cm×0.5 to 3.0 cm and 0.5 to 2.0 mm in thickness.

Figure 3:
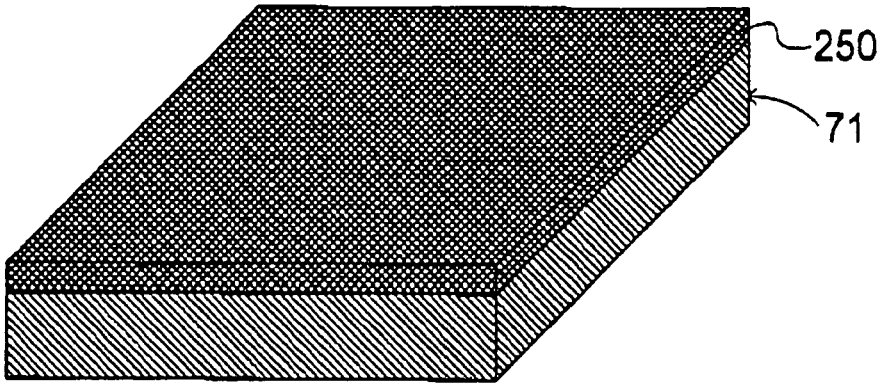
FIG. 3 shows a conductive sheet with a conductive auxiliary layer as being related to a method of manufacturing an anisotropic conductive sheet according to the embodiment of the present invention.

A method of manufacturing the anisotropic conductive sheet of the above embodiment will now be described with reference to FIGS. 3 to 9. FIG. 3, illustrates a conductive sheet 71 having a conductive auxiliary layer 250 adhered on the upper side thereof. The conductive auxiliary layer 250 can be adhered by various methods but is adhered by sputtering in this embodiment. Namely, the conductive sheet 71 is used as a base plate, a target is adjusted to meet the components of the conductive auxiliary layer to be prepared, and the conductive auxiliary layer is adhered by using a sputtering device. The conductive sheet of this embodiment is a conductive elastomer, and contrivance should be so made that the substrate temperature is not excessively elevated. For instance, there is used a magnetron or ion beam sputtering.

Figure 4:
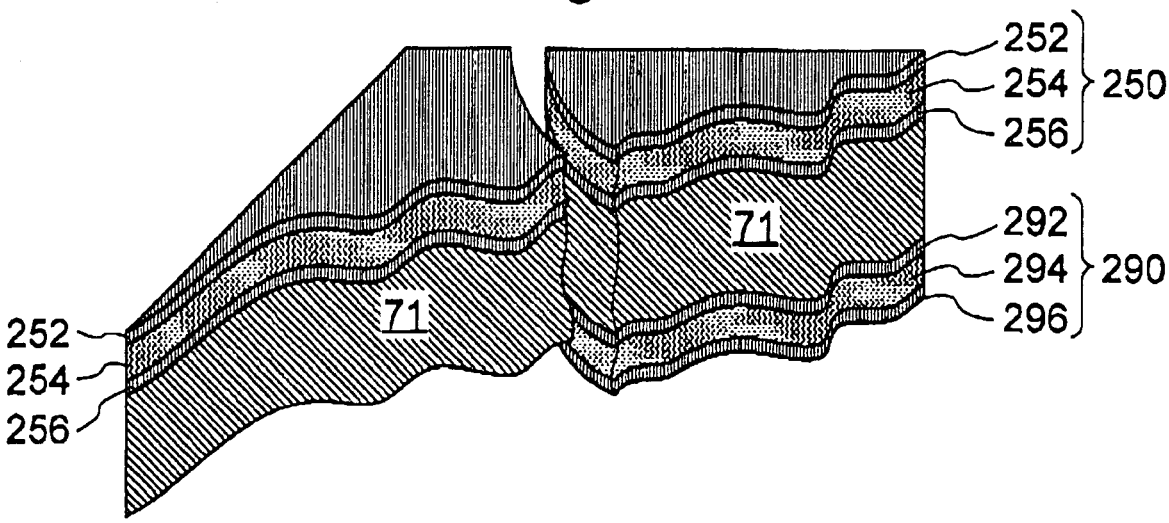
FIG. 4 shows another conductive sheet with a conductive auxiliary layer as being related to a method of manufacturing an anisotropic conductive sheet according to the embodiment of the present invention.

FIG. 4 illustrates, on the left side thereof, the conductive sheet 71 with the conductive auxiliary layer 250 adhered on the upper side thereof partly being broken away. In this embodiment, the conductive auxiliary layer is constituted by the adhesive layers 252, 256 and the conductive layer 254; i.e., the adhesive layer 256 is formed on the conductive sheet 71 and, then, the conductive layer 254 is formed and, finally, the adhesive layer 252 is formed. On the right side of FIG. 4, the conductive auxiliary layers are similarly adhered to both sides of the conductive sheet. This constitution enables the effect of the conductive auxiliary layers to be further exhibited. The above sheet member can be prepared by simultaneously adhering the conductive auxiliary layers onto both sides. Usually, however, one surface (e.g., conductive auxiliary layer 250) is, first, treated and is turned front side back, followed by the adhesion of the conductive auxiliary layer 290 on the other surface. The conductive auxiliary layer 290 adhered onto the other surface, too, is constituted by the adhesive layers 292, 296 and the conductive layer 294. The conductive auxiliary layer is to improve electric characteristics of the conductive sheet 71 and is, desirably, electrically contacted to the conductive sheet 71. The adhesive layers 256 and 292 are not to simply improve mechanical adhesion but also work to help electrical contact to the conductive layers 254 and 294.

Figure 5:
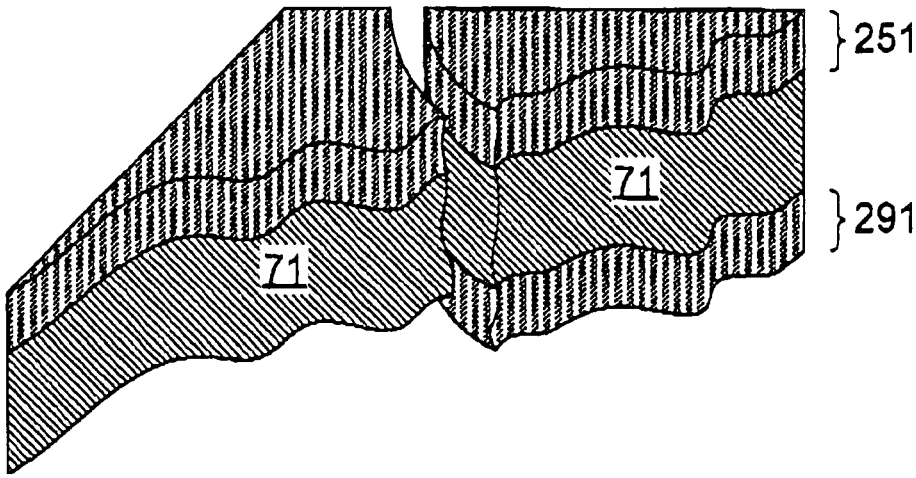
FIG. 5 shows a further conductive sheet with a conductive auxiliary layer as being related to a method of manufacturing an anisotropic conductive sheet according to the embodiment of the present invention.

FIG. 5 is a view illustrating, partly in a cut-away manner, the conductive sheet 71 to which the conductive auxiliary layers 251 and 291 are adhered without adhesive layer. The left side of FIG. 5 is an embodiment in which the conductive auxiliary layer 251 is formed on the upper side only of the conductive sheet 71, and the right side is an embodiment in which the conductive auxiliary layers 251 and 291 are adhered to both sides of the conductive sheet 71. In this embodiment, the structure is simpler than that of the case of FIG. 4, and the steps of manufacturing can be decreased. The conductive auxiliary layers 251 and 291 should be made of a material used for the conductive layers.

Figure 6:
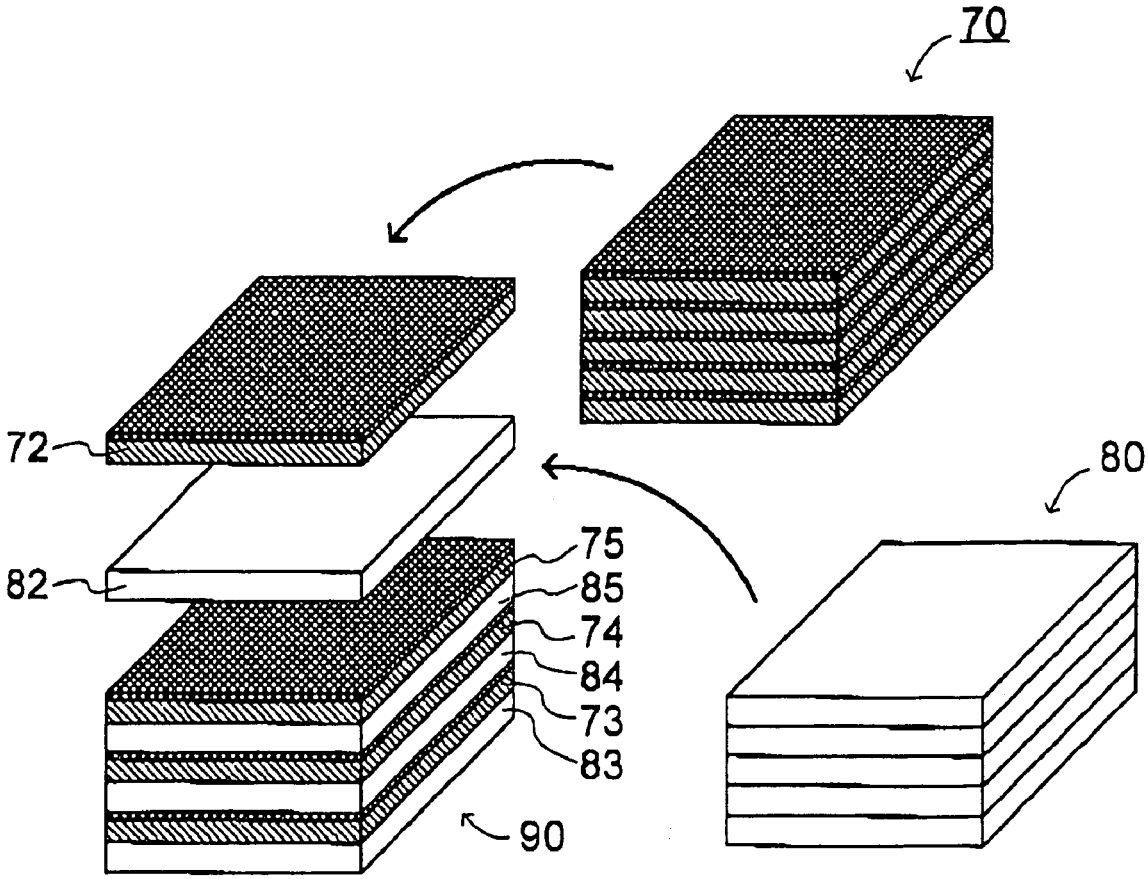
FIG. 6 illustrates a step of laminating conductive sheets with the conductive auxiliary layer and nonconductive sheets as being related to a method of manufacturing an anisotropic conductive sheet according to the embodiment of the present invention.

Referring to FIG. 6, there are provided conductive sheets (A) 70 with a conductive auxiliary layer and nonconductive sheets (B) 80, from which the sheet members are alternately stacked to prepare an AB sheet laminate (C) 90. On the AB sheet laminate (C) 90 being stacked, there are further stacked the nonconductive sheet (B) 82 and the conductive sheet (A) 72 with the conductive auxiliary layer further thereon. A coupling agent is applied among these sheet members so that the sheet members are coupled together. The nonconductive sheet (B) 83 is arranged at the lowest part of the AB sheet laminate (C) 90 which is being stacked. It should be noted that the thickness of this sheet member corresponds to ${}^{1}t_{11}$ in FIGS. 1 and 2, the thickness of the conductive sheet (A) 73 just thereon corresponds to ${}^{1}t_{21}$ in FIG. 2, and the thicknesses of the sheet members 84, 74, 85, 75 correspond, respectively, to the lengths of the conductive pieces 24, 28 and nonconductive pieces 22, 26 in FIG. 2. That is, lengths of the nonconductive piece and of the conductive piece with the conductive auxiliary layer in the strip-like member 14 of the striped pattern in FIGS. 1 and 2 can be freely varied by varying the thickness of these sheet members. Similarly, lengths of the conductive pieces and of the nonconductive pieces of the members of the strip-like member of the striped pattern sandwiched between the nonconductive strip-like members 40, correspond to the thickesses of the corresponding nonconductive sheet (B) and the conductive sheet (A). Usually, as fine pitches, these thicknesses are not larger than about 80 μm and are, more, preferably, not larger than about 50 μm. In this embodiment, the thicknesses are so adjusted that the nonconductive pieces have a length of about 30 μm and the conductive pieces have a length of about 50 μm.

To alternately stack the conductive sheets (A) and nonconductive sheets (B), the conductive sheets (A) may be continuously stacked in two or more pieces and, then, the nonconductive sheets (B) may be stacked in one or more pieces. The present invention may further include continuously stacking two or more pieces of nonconductive sheets (B) and, then, stacking one or more pieces of conductive sheets (A) alternately.

Figure 7:
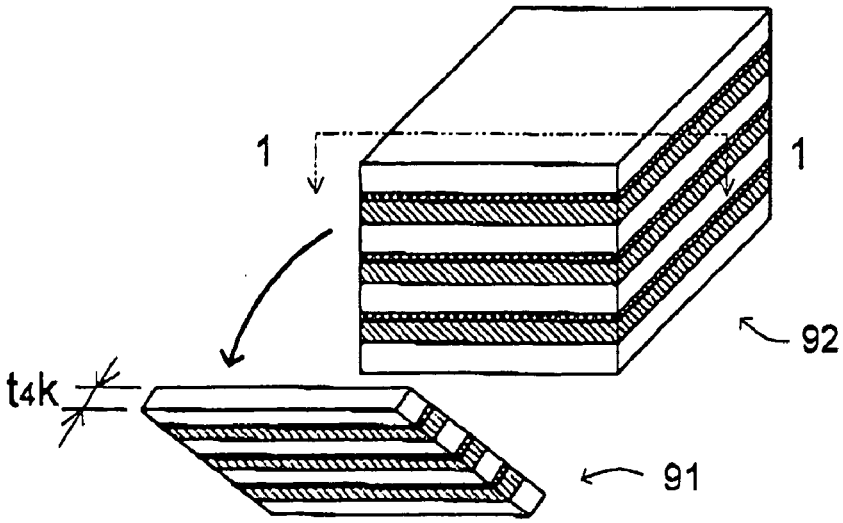
FIG. 7 illustrates a step of cutting a laminate of the conductive sheets with the conductive auxiliary layer and nonconductive sheets laminated in FIG. 6 as being related to a method of manufacturing an anisotropic conductive sheet according to the embodiment of the present invention.

FIG. 7 illustrates a first step of cutting the AB sheet laminate (C) 92 obtained by the step of obtaining the AB sheet laminate. The AB sheet laminate (C) 92 is cut along a cutting line 1-1 such that the thickness of the obtained zebra-like sheet 91 has a desired thickness $t_{4k}$ (k is a natural number). This thickness $t_{4k}$ corresponds to $t_{41}$ and $t_{42}$ in FIG. 2. Thus, the widths of the strip-like members 14 of the striped pattern in FIGS. 1 and 2 can be freely adjusted, and may all have the same width of different widths. Usually, the widths are not larger than about 80 μm and, more desirably, not larger than about 50 μm. In this embodiment, the widths are about 50 μm.

Figure 8:
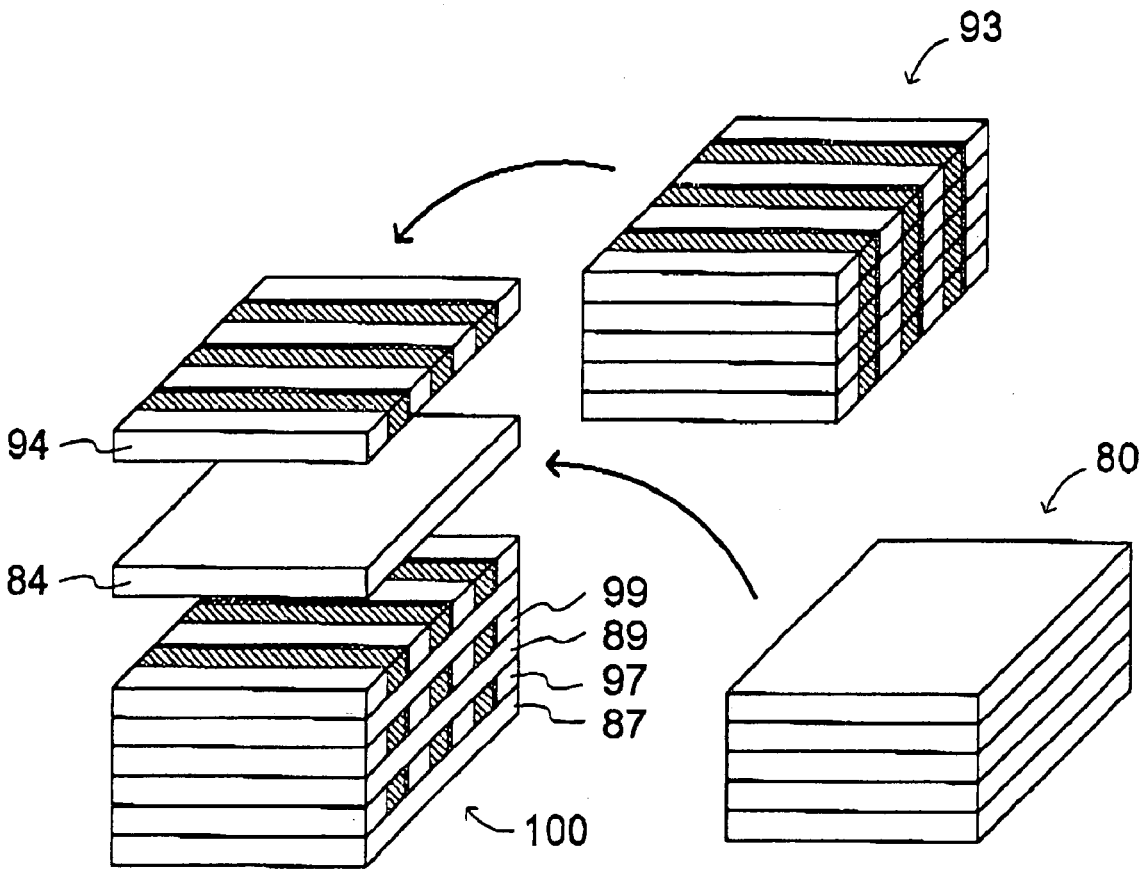
FIG. 8 illustrates a step of laminating the sheets cut in FIG. 7 and the nonconductive sheets as being related to, a method of manufacturing an anisotropic conductive sheet according to the embodiment of the present invention.

FIG. 8 illustrates the preparation of the zebra-D sheet laminate (E) by alternately laminating the zebra-like sheet 93 prepared in the above step and the nonconductive sheet (D) 80. On the zebra-D sheet laminate (E) 100 being stacked, there are further stacked the nonconductive sheet 84 and the zebra-like sheet 94 thereon. A coupling agent is applied among these sheet members so that the sheet members are coupled together. The nonconductive sheet (B) 87 is arranged at the lowest part of the zebra-D sheet laminate (E) 100 which is being stacked. It should be noted that the thickness of this sheet member corresponds to $t_{31}$ which is the width of the nonconductive strip-like member 12 in FIG. 2, the thickness of the sheet member 97 just thereon corresponds to $t_{41}$ in FIG. 2, and the thicknesses of the sheet members 89, 99 correspond, respectively to $t_{32}$. etc. in FIG. 2. That is, widths of the two kinds of strip-like members 12 and 14 in FIGS. 1 and 2 can be freely varied by varying the thickness of these sheet members. Usually, as fine pitches, these thicknesses are not larger than about 80 μm and are, more, preferably, not larger than about 50 μm. In this embodiment, the thicknesses are so adjusted that the nonconductive strip-like members 12 have a width of about 30 μm and the strip-like members 14 of the striped pattern have a width of about 50 μm.

Figure 9:
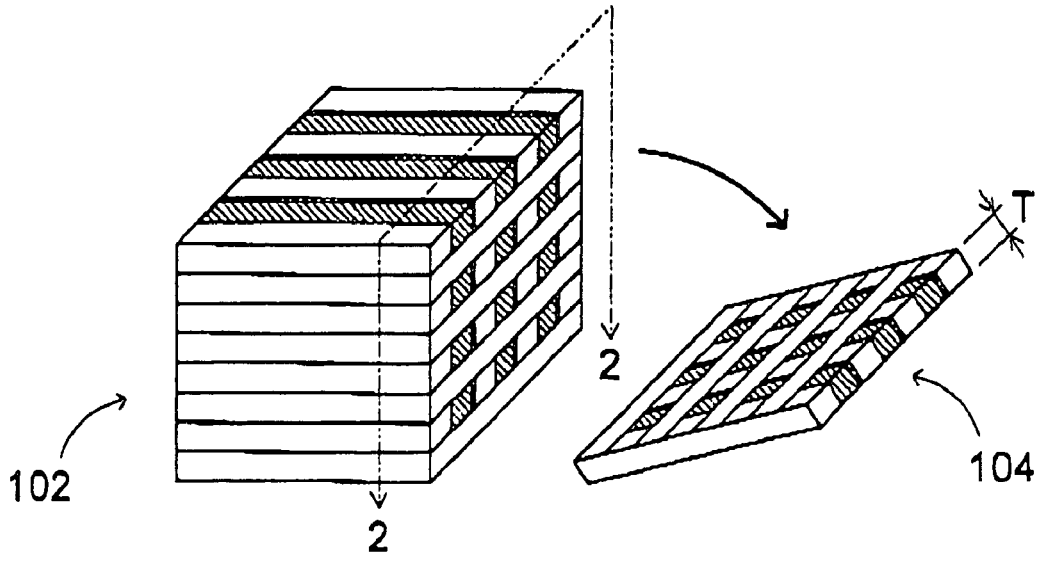
FIG. 9 illustrates a step of cutting the laminate obtained in FIG. 8 as being related to a method of manufacturing an anisotropic conductive sheet according to the embodiment of the present invention.

FIG. 9 illustrates the step of cutting the zebra-D sheet laminate (E) 102 obtained through the step of obtaining the zebra-D sheet laminate. The laminate 102 is cut along a cutting line 2-2 such that the obtained anisotropic conductive sheet 104 will have a desired thickness T. Therefore, this makes it easy to prepare a thin anisotropic conductive sheet and a thick anisotropic conductive sheet which are usually difficult to obtain. Though the thickness is usually about 1 mm, the thickness can be decreased to be about 100 μm (or not larger than about 50 μm when particularly desired) or can be increased to be about several millimeters. In this embodiment, the thickness is selected to be about 1 mm.

Figure 10:
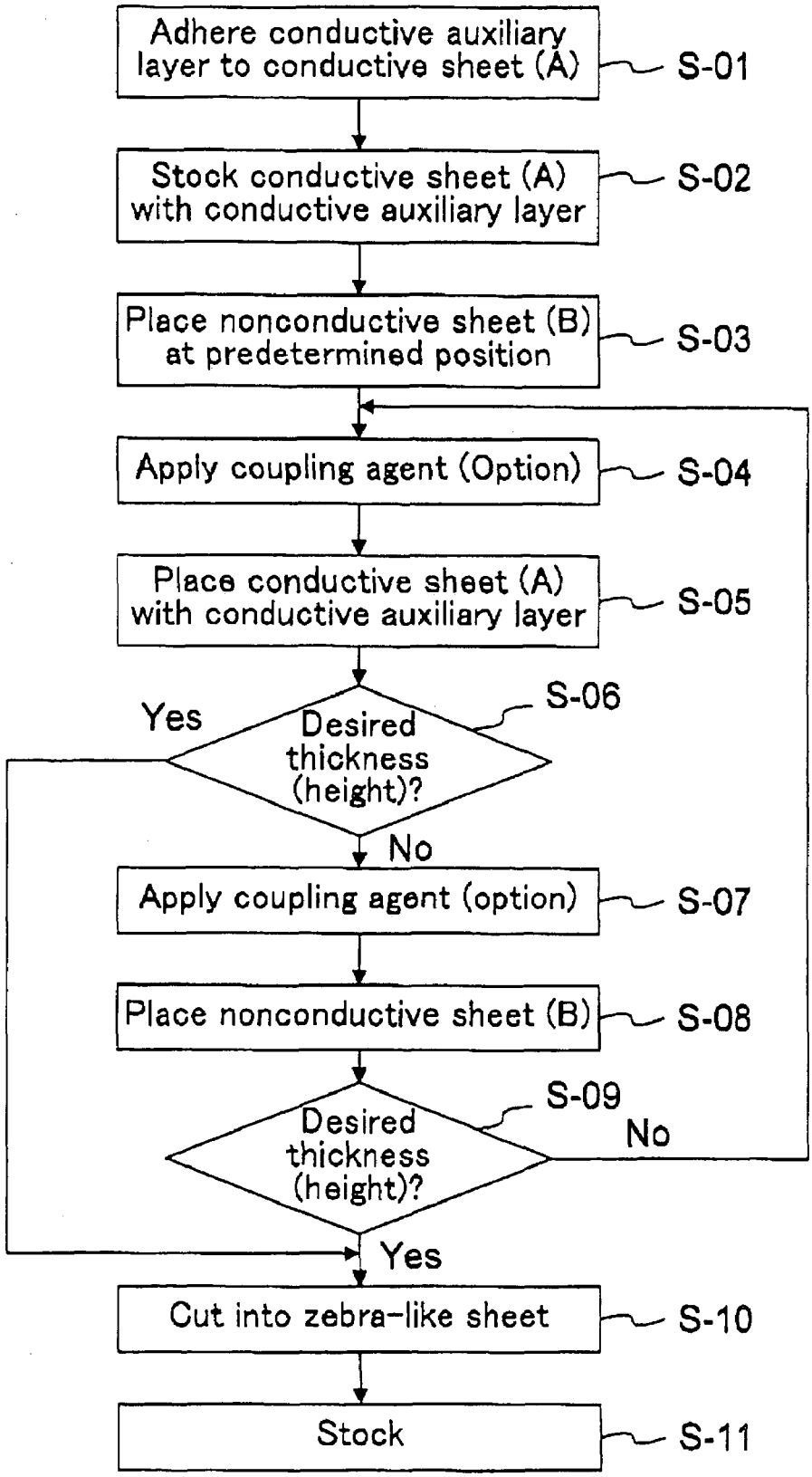
FIG. 10 is a flowchart illustrating a method of preparing an AB sheet laminate (C) and a zebra-like sheet in the method of manufacturing the anisotropic conductive sheet according to the embodiment of the present invention.
Figure 11:
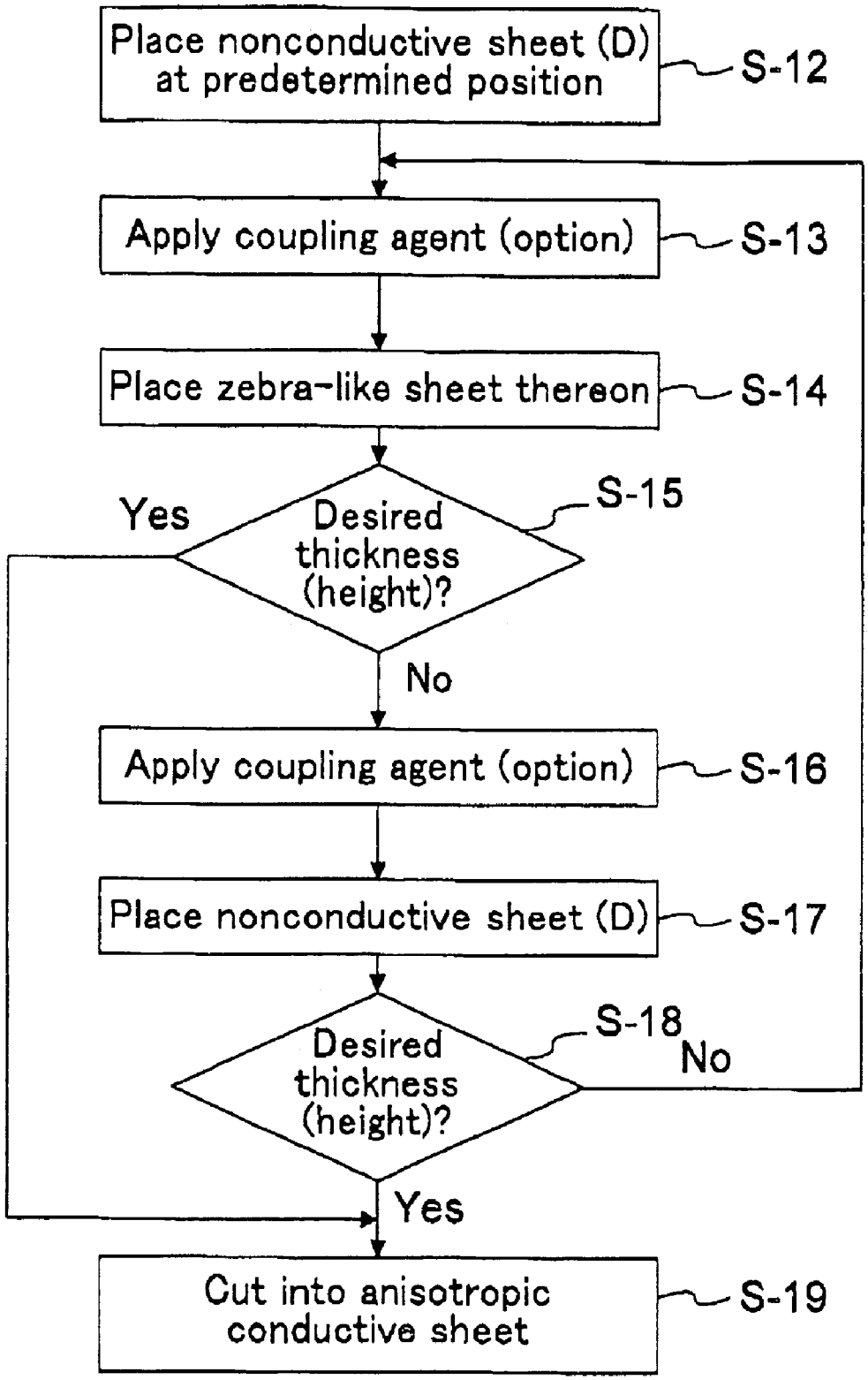
FIG. 11 is a flowchart illustrating a method of preparing an anisotropic conductive sheet from the zebra-like sheet and the like in the method of manufacturing the anisotropic conductive sheet according to the embodiment of the present invention.

FIGS. 10 and 11 are flowcharts illustrating a method of manufacturing the above anisotropic conductive sheet. FIG. 10 illustrates steps of preparing the zebra-like sheet. First, the conductive auxiliary layer is adhered on the conductive sheet (A)(S-01). In this embodiment, the conductive auxiliary layer is formed by sputtering on one surface only of the conductive sheet. The conductive sheet (A) with the conductive auxiliary layer is stocked for use in the next step (S-02). Next, the nonconductive sheet (B) is placed at a predetermined position for stacking (S-03). Optionally, the coupling agent is applied onto the nonconductive sheet (B)(S-04). This step may be omitted, as a matter of course, since it is optional (the same holds hereinafter). The conductive sheet (A) with the conductive auxiliary layer is placed thereon (S-05). Check if the thickness (or height) of the stacked AB sheet laminate (C) is reaching a desired thickness (or height)(S-06). If the desired (predetermined) thickness has been reached, the routine proceeds to the first step of cutting (S-10). If the desired (predetermined) thickness has not been reached, the coupling agent is optionally applied onto the conductive sheet (A)(S-07). The nonconductive sheet (B) is placed thereon (S-08). Check if the thickness (or height) of the stacked AB sheet laminate (C) is reaching a desired thickness (or height)(S-09). If the desired (predetermined) thickness has been reached, the routine proceeds to the first step of cutting (S-10). If the desired (predetermined) thickness has not been reached, the routine returns back to step S-04 where the coupling agent is optionally applied onto the conductive sheet (A). At the step of cutting (S-10), the zebra-like sheet is cut out piece by piece or in a plurality of number of pieces at one time, and the zebra-like sheets are stocked (S-11).

FIG. 11 illustrates steps of preparing an anisotropic conductive sheet from the zebra-like sheet and the nonconductive sheet (D). First, the nonconductive sheet (D) is placed on a predetermined position for stacking (S-12). Optionally, the coupling agent is applied onto the nonconductive sheet (D) (S-13). The zebra-like sheet is placed thereon (S-14). Check if the thickness (or height) of the stacked zebra-D sheet laminate (E) is reaching a desired thickness (or height)(S-15). If the desired (predetermined) thickness has been reached, the routine proceeds to the second step of cutting (S-19). If the desired (predetermined) thickness has not been reached, the coupling agent is optionally applied onto the zebra-like sheet (S-16). The nonconductive sheet (D)is placed thereon (S-17). Check if the thickness (or height) of the zebra-D sheet laminate (E) is reaching a desired thickness (or height)(S-18). If the desired (predetermined) thickness has been reached, the routine proceeds to the second step of cutting (S-19). If the desired (predetermined) thickness has not been reached, the routine returns back to step S-13 where the coupling agent is optionally applied onto the nonconductive sheet (D). At the second step of cutting (S-19), the anisotropic sheet is cut out piece by piece or in a plurality of number of pieces at one time.

Figure 12:
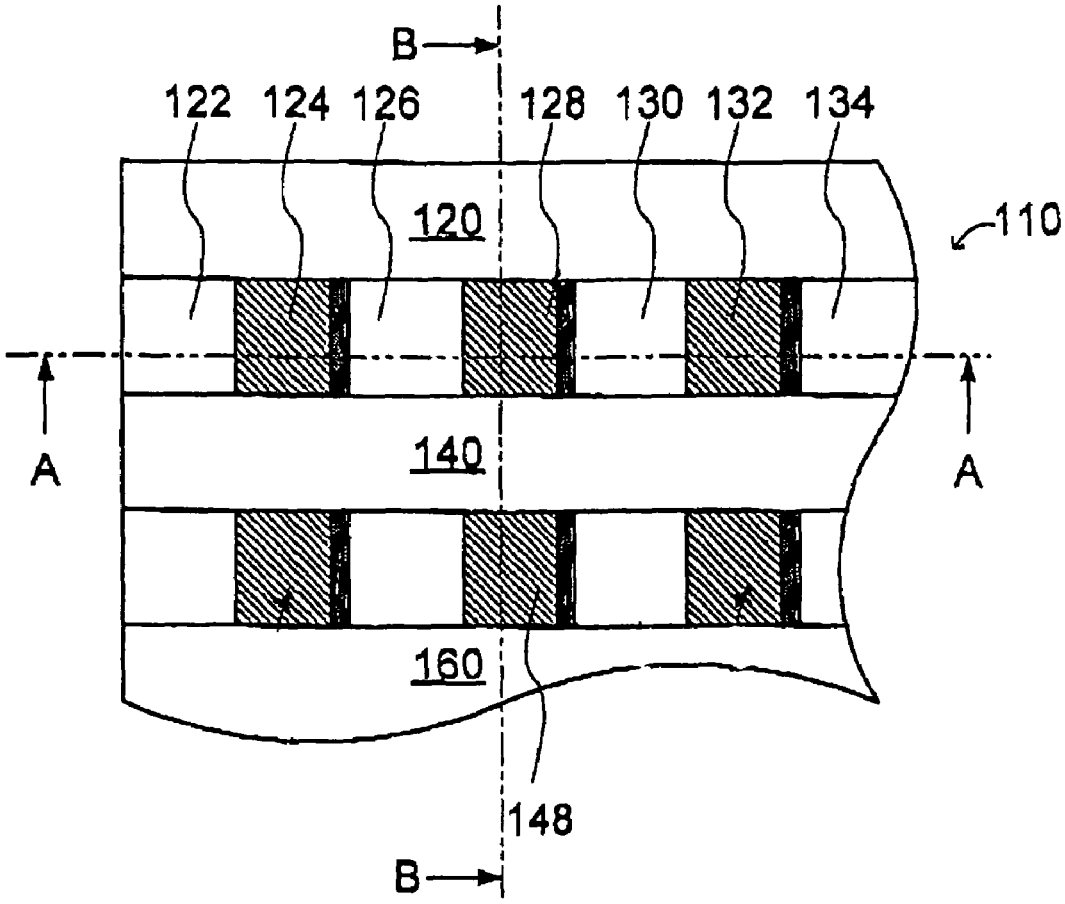
FIG. 12 is a plan view of an anisotropic conductive sheet according to another embodiment of the present invention.
Figure 13:
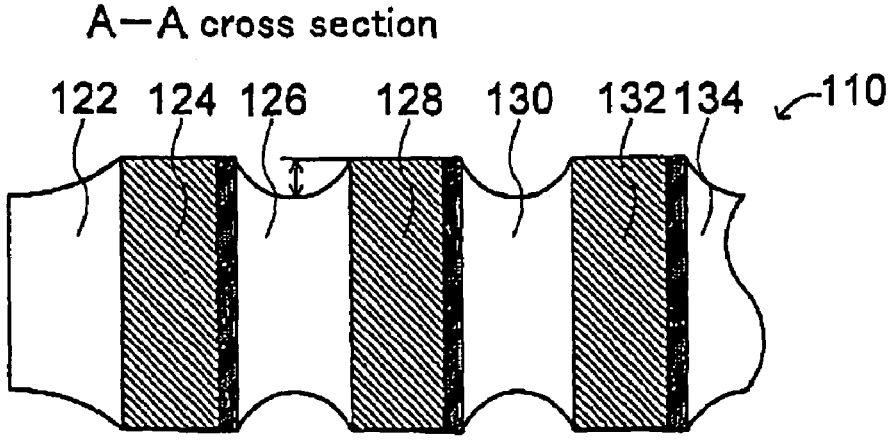
FIG. 13 is a sectional view along A-A of the anisotropic conductive sheet according to the embodiment of the present invention shown in FIG. 12.
Figure 14:
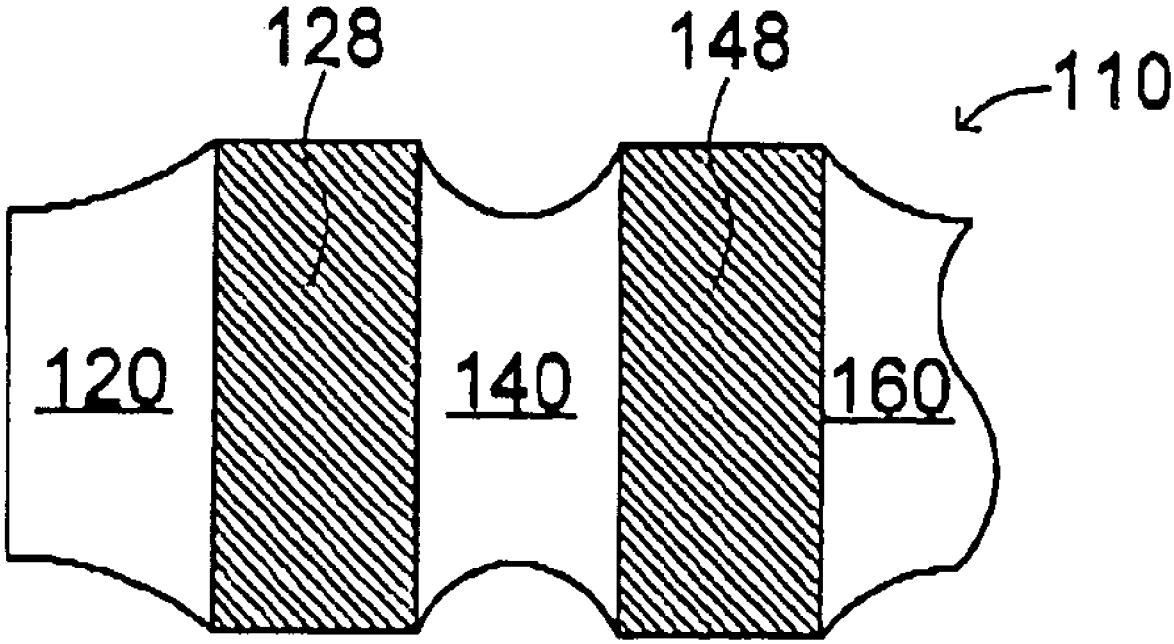
FIG. 14 is a sectional view along B-B of the anisotropic conductive sheet according to the embodiment of the present invention shown in FIG. 12.

FIGS. 12, 13 and 14 illustrate another embodiment. In this embodiment, an anisotropic conductive sheet 110 is prepared according to the above method by using conductive sheets that have been cured and nonconductive sheets that have not been cured. FIGS. 13 and 14 are sectional views of the anisotropic conductive sheet 110 along the lines A-A and B-B. As will be understood from these drawings, the conductive pieces 124, 128, 132 and 148 with the conductive auxiliary layer are protruded on the surface of the sheet to be higher than the nonconductive pieces 122, 126, 130, 134, 120, 140 and 160 offering improved reliability of contact. This form is assumed since uncured rubber has contracted due to the heating. Here, the conductive elastomer has been cured and the nonconductive elastomer has not been cured. The uncured nonconductive elastomer can be adhered to the cured elastomer by heating or the like. In the above manufacturing method, therefore, the optional coupling agent needs not necessarily be added and may be omitted from the steps.

As described above, the anisotropic conductive sheet of the present invention has the effect of not only maintaining insulation in the direction of the plane while exhibiting satisfactory conductivity in the direction of thickness but also enabling the sizes such as lengths of the nonconductive pieces and conductive pieces to be freely set to easily accomplish fine pitches desired for achieving a high degree of integration. When the conductive auxiliary layer penetrating through in the direction of thickness is directly exposed on the front surface and on the back surface, it is considered that the conductivity becomes particularly high. Further, since the conductive members and nonconductive members are chemically bonded together (crosslinking of rubber), the conductive portions do not slip out which, otherwise, tend to occur when a linear metal is used as conductive portions. Besides, the conductive pieces are necessarily surrounded by the nonconductive pieces avoiding contact caused by the approach/contact of conductive particles of a metal in the direction of plane of the anisotropic conductive sheet in which conductive particles are mixed.

What is claimed is:

1. An anisotropic conductive sheet expanding on a first plane, wherein: when a first direction contained in said first plane is denoted as X-direction, a direction orthogonal to X-direction and contained in said first plane is denoted as Y-direction and a direction orthogonal to X-direction and Y-direction is denoted as Z-direction, and the anisotropic conductive sheet has a predetermined thickness in Z-direction and a front surface and a back surface substantially in parallel with said first plane, the anisotropic conductive sheet comprising:

strip-like members of a striped pattern having a width in Y-direction and extending in X-direction and conductive pieces having electric conductivity and nonconductive pieces alternately arranged in X-direction;

nonconductive strip-like members having a width in Y-direction and extending in X-direction, wherein the strip-like members and the nonconductive strip-like members are arranged relative to each other in Y-direction, and wherein in said strip-like members of a striped pattern, a conductive auxiliary layer is arranged between the conductive piece and the nonconductive piece while in contact with said conductive piece so that the conductive piece is sandwiched between the conductive auxiliary layers;

a thickness of the conductive auxiliary layer is not greater than 1/50 of the conductive piece;

said conductive auxiliary layer includes a conductive layer and adhesive layers disposed at both sides of the conductive layer extending in Y-direction; and said conductive pieces and the conductive auxiliary layer extend in Z-direction so as to penetrate the anisotropic conductive sheet from the front surface to the back surface.

2. The anisotropic conductive sheet according to claim 1, wherein the adhesive layer comprises indium tin oxide.

3. The anisotropic conductive sheet according to claim 1, wherein the nonconductive pieces and the nonconductive strip-like members comprise a nonconductive elastomer and the conductive pieces comprise a conductive elastomer.

4. The anisotropic conductive sheet according to claim 1, wherein the conductive pieces are protruded as compared to surroundings thereof along Z-direction.

* * * * *